United States Patent [19]

Yagi et al.

[11] 4,231,890

[45] Nov. 4, 1980

[54] BLEACHING COMPOSITION CAUSING NO COLOR CHANGE OR FADING OF COLORED AND FIGURED CLOTHS

[75] Inventors: Kouichi Yagi, Tokyo; Yunosuke Nakagawa, Soka, both of Japan

[73] Assignee: Kao Soap Co., Ltd., Tokyo, Japan

[21] Appl. No.: 957,082

[22] Filed: Nov. 2, 1978

[30] Foreign Application Priority Data

Nov. 25, 1977 [JP] Japan ..... 52-141351

[51] Int. Cl.[3] ..... C11D 7/54; C11D 3/395; D06L 3/02

[52] U.S. Cl. ..... 252/186; 8/111; 252/99; 252/102; 423/272; 423/273; 423/582

[58] Field of Search ..... 252/186, 99, 102; 8/111; 423/272, 273, 582

[56] References Cited

U.S. PATENT DOCUMENTS

| | | | |
|---|---|---|---|
| 3,969,257 | 7/1976 | Murray | 252/186 |
| 4,120,809 | 10/1978 | Murray | 252/186 |

*Primary Examiner*—Benjamin R. Padgett
*Assistant Examiner*—Irwin Gluck
*Attorney, Agent, or Firm*—Blanchard, Flynn, Thiel, Boutell & Tanis

[57] ABSTRACT

A bleaching composition which does not cause color change or fading of fabrics, which composition contains 50 to 98 weight % of a peroxide which releases oxygen in an aqueous solution, 1 to 49 weight % of nitrilotriacetic acid or salt thereof and 1 to 49 weight % of a water softener as critical components.

9 Claims, No Drawings

BLEACHING COMPOSITION CAUSING NO COLOR CHANGE OR FADING OF COLORED AND FIGURED CLOTHS

BACKGROUND OF THE INVENTION

1. Field of the Invention

The present invention relates to an oxygen-type bleaching composition, particularly a bleaching composition capable of safely bleaching even colored and figured cloths colored with a metal complex dye or a metal complex pigment.

2. Description of the Prior Art

Oxidation reactions are generally utilized for bleaching cloths for domestic and commercial purposes. In most cases, chlorine-containing bleaching agents are used. However, colored and figured cloths cannot be bleached safely with the chlorine-containing bleaching agents. Recently, oxygen-type bleaching agents capable of bleaching even colored and figured cloths have been used. However, it has been proved that the oxygen-type bleaching agents have insufficient safety for bleaching colored and figured (printed) cloths dyed with a metal-containing dye or pigment or treated with a metal salt or a metal-containing fixing agent.

General purpose bleaching compositions containing 50 to 100% of an inorganic peroxide sometimes cause color change and fading under usual treatment conditions (temperature: 40°–60° C., concentration: 0.3–1.0%), whereas bleaching compositions containing a surfactant, an inorganic peroxide and a builder (usually containing 10 to 50 weight % of an inorganic peroxide) do not cause color change or fading of colored and figured cloths under usual treatment conditions (temperature: 10°–40° C., concentration: 0.05–0.2 weight %). Thus, the color change and fading of colored and figured cloths are problems peculiar to the bleaching compositions containing a relatively high concentration (50 weight % or more) of an inorganic peroxide.

In the use of oxygen-type bleaching agents, there have been proposed various ideas for stabilizing the peroxide in the bleaching bath, preventing a fluorescent brightening agent from reduction in activity and preventing textile and fibers from deterioration. For example, there has been proposed the idea of adding a chelating agent or a magnesium salt for this purpose. However, those processes have disadvantages such that when colored and figured cloths dyed with a metal-containing dye or pigment or colored and figured cloths treated with a metal salt or a metal-containing fixing agent are bleached by those processes, an extremely large amount of the peroxide-stabilizing agent is required, the tints of the cloths are changed or the effect of the addition of the chelating agent or magnesium salt is not exhibited.

After intensive investigations on those problems, the inventors found that the use of aminocarboxylic acid salts is relatively effective to ameliorate those problems.

However, it has also been found that the tendency of the aminocarboxylic acid salts to prevent the color change or fading is completely different from the tendency for stabilizing the peroxide. Namely, for stabilizing the peroxides used in the conventional processes, it has been desired to use a substance which chelates powerfully heavy metals which latter act as decomposition catalysts for the peroxides. However, for the prevention of color change or fading according to the present invention, a tendency opposite to said peroxide-stabilizing tendency has been recognized. Surprisingly, it has further been found that when a water softener is added to the aminocarboxylic acid salts, only nitrilotriacetic acid and its salts exhibit a specific excellent effect whereas the other aminocarboxylic acid salts do not exhibit said effect. The present invention has been completed on the basis of this finding.

SUMMARY OF THE INVENTION

The present invention provides a bleaching composition which does not cause appreciable color change or fading of colored and figured cloths containing (a) a peroxide which releases oxygen in aqueous solution, (b) nitrilotriacetic acid (hereinafter referred to as NTA), salt thereof or mixture thereof and (c) a water softener, as critical components.

The object of the present invention is to provide a bleaching composition which does not cause appreciable color change or fading of colored and figured cloths by using a combination of substances commercially available in large amounts at a low cost, such as NTA, salts thereof and water softeners.

The peroxides which release oxygen in aqueous solution employed herein include peroxides and hydrogen peroxide adducts of water-soluble inorganic and organic salts such as peroxides and hydrogen peroxide adducts of alkali metal carbonates, phosphates, sulfates, silicates and polycarboxylates. As preferred examples of the peroxides, there can be mentioned sodium percarbonate ($2Na_2CO_3.3H_2O_2$), sodium perborate ($NaBO_3.4H_2O$), sodium sulfate/sodium chloride/hydrogen peroxide adduct ($4Na_2SO_4.NaCl.2H_2O_2$) and tetrasodium ethane-1,1,2,2-tetracarboxylate/hydrogen peroxide adduct ($[CH(CO_2\text{-}Na)_2]_2.H_2O_2$).

The amount of the peroxide which releases oxygen in water is 50 to 98 weight %, preferably 80 to 95 weight %, based on the total weight of the bleaching composition of the present invention.

The use of less than 1% of NTA or salt thereof, provides an insufficient prevention effect. Therefore, NTA, salt thereof or mixture thereof is incorporated in an amount of 1 to 49 weight %, preferably 3 to 10 weight %, based on the total weight of the composition. The salt of nitrilotriacetic acid is preferably disodium salt and trisodium salt.

The water softener used in the present invention is a substance used for removing or masking calcium and magnesium ions contained in hard water to convert the hard water into soft water. The water softeners may be classified into the following three groups according to the actions thereof. Any water softeners having the following properties can be used in the present invention.

(a) Water softeners which precipitate calcium and magnesium ions as water-insoluble compounds, (b) Water softeners which remove calcium and magnesium ions by ion exchange, and (c) Water softeners which form water-soluble chelate compounds to sequester said calcium and magnesium ions.

As the water softeners usable in the present invention, there can be mentioned polyphosphoric acids and salts thereof such as sodium tripolyphosphate, sodium pyrophosphate and sodium hexametaphosphate; polycarboxylic acids and salts thereof such as sodium diglycollic acid, sodium DL-malate, sodium sulfosuccinate, sodium glutarate, sodium oxalacetate, sodium sulfoitaconate, sodium sulfotricarballylate, sodium ethanetetracarboxylate, sodium adipate, sodium tartrate, sodium n-citrate, sodium DL-isocitrate, sodium hydroxydisuccinate and sodium pyromellitate; sodium polyacrylates of an average molecular weight of 3,000 to 70,000; and aluminosilicates such as Synthetic Zeolite A-4 and Synthetic Zeolite F-9. "Zeolite" is a general term for inorganic ion exchangers, particularly silicic acid-type ion exchangers represented by the general formula:

$$(Na_2O)_x.Al_2O_3.(SiO_2)_y$$

wherein x and y are numbers of 0.7–1.5 and 0.8–6.0, respectively. There are various silicic acid-type ion exchangers depending on the values of x and y.

The purpose of incorporating the water softener is to prevent the aminocarboxylic acid salts (used for preventing color change or fading) from reacting with calcium and magnesium ions during use. It has been found that in combination with the water softeners, only NTA and salts thereof possess an improved specific effect of preventing the color change or fading.

The amount of the water softener used is variable depending on the particular water softener substance that is used, because they are different from one another in their calcium-capturing capacity. Generally, the amount of the water softener is 1 to 49 weight %, particularly preferably 2 to 10 weight %, based on the total weight of the composition.

The bleaching composition of the present invention may optionally contain other known adjunct substances usually added to bleaching compositions in addition to the above-mentioned critical components. For example, there may be used builders such as water-soluble inorganic builders, for example, sulfates, carbonates, bicarbonates, silicates and phosphates and organic builders, for example, ethylene-diamine tetraacetate, tartrates and citrates. As stabilizers for peroxides or hydrogen peroxide adducts, there may be used known magnesium salts such as magnesium sulfate, magnesium silicate, magnesium chloride, magnesium silicofluoride, magnesium oxide and magnesium hydroxide and silicates such as sodium silicate. Further, if necessary, there may be incorporated in the composition soil redeposition preventing agents such as carboxymethylcellulose, polyvinylpyrrolidone and polyethyleneglycol and activating agents for the peroxides such as N-acylated compounds, organic acid anhydrides and esters. As still further components of the composition, there may be incorporated therein various surfactants, enzymes, fluorescent brightening agents, dyes, pigments and perfumes.

By using the bleaching composition of the present invention, it is possible safely to bleach colored and figured cloths dyed with metal complex dyes or pigments or colored and figured cloths treated with metal salt or metal-containing fixing agents.

The following examples further illustrate the present invention. In the examples, percentages and parts are given by weight.

EXAMPLE 1

(Preparation of dyed cloth)

Cotton broadcloth #60 was dyed with Color Index, Direct Blue 248 (direct dye of non-metal complex-type) by the dip dyeing process.

| Dyeing conditions: | |
|---|---|
| Bath ratio: | 1:20 |
| Dyeing concentration: | 4.0% o.w.f. (based on weight of the fabric or fiber) |
| Temperature/time: | 90° C./45 mins. |
| Anhydrous sodium sulfate: | 30% o.w.f. |
| Sodium carbonate: | 1% o.w.f. |

After washing with water followed by removal of free water, the cloth was further subjected to a fixing treatment.

| Fixing treatment conditions: | |
|---|---|
| Treating agent: | Sanfix 555C (a metal-containing fixing agent of San'yo Kasei Co.) |
| Bath ratio: | 1:20 |
| Temperature/time | 60° C./20 mins. |
| Concentration | 3 g/l. |

After washing with water followed by removal of free water, the cloth was dried to obtain the dyed cloth.

The cloth thus dyed can be very easily changed in color and can be faded.

The dyed cloth was treated with various bleaching compositions as shown below.

| Bleaching composition: | |
|---|---|
| $2Na_2CO_3 . 3H_2O_2$ | 80 parts |
| An aminocarboxylic acid or a salt thereof or Glauber's salt (as listed in the following Table 1) | 10 parts |
| Sodium tripolyphosphate | 10 parts |
| **Bleaching conditions:** | |
| Bath ratio: | 1:50 |
| Concentration: | 0.5% |
| Temperature/time: | 50° C./30 mins. |
| Water used: | city water (3° dH) |

The results are shown in Table 1.

The color change and fading fastness were evaluated according to the discoloration and fading grey scale of JIS L 0804 (1974).

Grades:

5: No change (no decoloring)
4: Slight change
3: Clear change (slight decoloring)
2: Relatively remarkable change
1: Remarkable change (substantially complete decoloring)

TABLE 1

| Aminocarboxylic acid or salt thereof | Grade of color change or fading |
|---|---|
| Iminodiacetic acid (comparison) | 4 |
| Nitrilotriacetic acid (invention) | 5 |
| Trisodium nitrilotriacetate (invention) | 5 |
| Hydroxyethyliminodiacetic acid (comparison) | 4 |
| Dihydroxyethylglycine (comparison) | 4 |
| Ethylenediaminediacetic acid (comparison) | 4 |
| Nitrilotripropionic acid (comparison) | 4 |
| Tetrasodium ethylenediamine tetra- | 3 |

TABLE 1-continued

| Aminocarboxylic acid or salt thereof | Grade of color change or fading |
|---|---|
| acetate (comparison) | |
| Diethylenetriaminepentaacetic acid (comparison) | 2 |
| Triethylenetetramine hexaacetic acid (comparison) | 1 |
| Glauber's salt (comparison) | 1 |

COMPARATIVE EXAMPLE 1

A dyed cloth prepared in the same manner as described in Example 1 was treated with the following various bleaching compositions:

| | |
|---|---|
| Bleaching composition: | |
| $2Na_2CO_3 . 3H_2O_2$ | 90 parts |
| An aminocarboxylic acid or a salt thereof or Glauber's salt (as listed in the following Table 2) | 10 parts |
| Bleaching conditions: | |
| Bath ratio: | 1:50 |
| Concentration: | 0.5% |
| Temperature/time: | 50° C./30 mins. |
| Water used: | city water (3° dH) |

The results are shown in Table 2.

TABLE 2

Effect of preventing color change and fading:

| Aminocarboxylic acid or salt thereof | Grade of color change or fading |
|---|---|
| Iminodiacetic acid | 4 |
| Nitrilotriacetic acid | 4 |
| Trisodium nitrilotriacetate | 4 |
| Hydroxyethyliminodiacetic acid | 4 |
| Ethylenediaminediacetic acid | 4 |
| Dihydroxyethylglycine | 4 |
| Ethylenediaminedipropionic acid | 4 |
| Nitrilotripropionic acid | 4 |
| Hydroxyethylethylenediaminetriacetic acid | 3 |
| Ethylenediamine-di-o-hydroxyphenylacetic acid | 3 |
| Ethylenediaminediacetic acid dipropionic acid | 3 |
| Diaminopropanetetraacetic acid | 3 |
| m-Phenylenediaminetetraacetic acid | 3 |
| Tetrasodium ethylenediamine tetraacetate | 3 |
| Trans-1,2-cyclohexanediaminetetraacetic acid | 3 |
| Diaminopropanol tetraacetic acid | 2 |
| Diethylenetriaminepentaacetic acid | 2 |
| Glycol etherdiaminetetraacetic acid | 2 |
| Triethylenetetraminehexaacetic acid | 1-2 |
| Glauber's salt | 1 |

EXAMPLE 2

The fading and discoloration-preventing effects of nitrilotriacetic acid and salts thereof used in various amounts were examined.

| Bleaching composition: | |
|---|---|
| $2Na_2CO_3 . 3H_2O_2$ | 80 parts |
| Nitrilotriacetic acid or salt thereof | X parts (as listed in Table 3) |
| Sodium tripolyphosphate | 10 parts |
| Glauber's salt | Balance |

TABLE 3

| | X Amount (parts) | Grade of Color change or fading |
|---|---|---|
| | 10 (Invention) | 5 |
| | 5 (Invention) | 5 |
| Nitrilotriacetic acid | 3 (Invention) | 5 |
| | 1 (Invention) | 5 |
| | 0.5 (Comparison) | 3 |
| | 10 (Invention) | 5 |
| | 5 (Invention) | 5 |
| Trisodium nitrilotriacetic acid | 3 (Invention) | 5 |
| | 1 (Invention) | 5 |
| | 0.5 (Comparison) | 2 |

The bleaching conditions were the same as those of Example 1. The results are shown in Table 3.

TABLE 3

| | X Amount (parts) | Grade of color change or fading |
|---|---|---|
| | 10 (Invention) | 5 |
| | 5 (Invention) | 5 |
| Nitrilotriacetic acid | 3 (Invention) | 5 |
| | 1 (Invention) | 5 |
| | 0.5 (Comparison) | 3 |
| | 10 (Invention) | 5 |
| Trisodium nitrilotriacetic acid | 5 (Invention) | 5 |
| | 3 (Invention) | 5 |
| | 1 (Invention) | 5 |
| | 0.5 (Comparison) | 2 |

EXAMPLE 3

The fading and discoloration-preventing effects were examined in the same manner as in Example 2 except that sodium tripolyphosphate was replaced with different water softeners.

| Bleaching composition: | |
|---|---|
| $2Na_2CO_3 . 3H_2O_2$ | 80 parts |
| Trisodium nitrilotriacetate | 5 parts |
| Water softener (as listed in Table 4) | 10 parts |
| Glauber's salt | 5 parts |

The bleaching conditions were the same as those of Example 1. The results are shown in Table 4.

TABLE 4

| | Water softener | Grade of color change or fading |
|---|---|---|
| Trisodium nitrilotriacetate | Sodium pyrophosphate | 5 |
| | Sodium hexametaphosphate | 5 |
| | Sodium diglycollate | 5 |
| | Sodium DL-malate | 5 |
| | Sodium sulfosuccinate | 5 |
| | Sodium glutarate | 5 |
| | Sodium oxalacetate | 5 |
| | Sodium sulfoitaconate | 5 |
| | Sodium sulfotricarballylate | 5 |
| | Sodium ethanetetracarboxylic acid | 5 |
| | Sodium adipate | 5 |
| | Sodium tartrate | 5 |
| | Sodium n-citrate | 5 |
| | Sodium DL-isocitrate | 5 |
| | Sodium oxydisuccinate | 5 |
| | Sodium pyromellitate | 5 |
| | Sodium polyacrylate (MW = 4000-5000) | 5 |
| | Synthetic Zeolite A-4 | 5 |

TABLE 4-continued

| Water softener | Grade of color change or fading |
|---|---|
| (Sodium aluminosilicate) | |

EXAMPLE 4

The amounts of the water softeners used in Examples 3 and 4 were varied to examine their effects.

| Bleaching composition: | |
|---|---|
| $2Na_2CO_3 . 3H_2O_2$ | 80 parts |
| Trisodium nitrilotriacetate | 5 parts |
| Water softener | Y parts (as listed) in Table 5) |
| Glauber's salt | Balance |

The bleaching conditions were the same as those of Example 1. The results are shown in Table 5.

TABLE 5

| Water softener | Y parts | Grade of color change or fading |
|---|---|---|
| | 5 (Invention) | 5 |
| Sodium tripoly- | 3 (Invention) | 5 |
| phosphate | 2 (Invention) | 5 |
| | 1 (Invention) | 5 |
| | 0.5 (Comparison) | 4 |
| | 5 (Invention) | 5 |
| Sodium pyro- | 3 (Invention) | 5 |
| phosphate | 2 (Invention) | 5 |
| | 1 (Invention) | 5–4 |
| | 0.5 (Comparison) | 3 |
| | 5 (Invention) | 5 |
| Synthetic Zeolite | 3 (Invention) | 5 |
| A-4 | 2 (Invention) | 5 |
| | 1 (Invention) | 4–5 |
| | 0.5 (Comparison) | 3 |
| | 5 (Invention) | 5 |
| Sodium n-citrate | 3 (Invention) | 5 |
| | 2 (Invention) | 5 |
| | 1 (Invention) | 5 |
| | 0.5 (Comparison) | 4 |
| | 5 (Invention) | 5 |
| Sodium ethane- | 3 (Invention) | 5 |
| tetracarboxylate | 2 (Invention) | 5 |
| | 1 (Invention) | 5 |
| | 0.5 (Comparison) | 5–4 |

EXAMPLE 5

The same treatment as in Example 5 was effected except that sodium percarbonate ($2Na_2CO_3.3H_2O_2$) was replaced with another peroxide.

| Bleaching composition: | |
|---|---|
| Peroxide (as listed in Table 6) | 80 parts |
| Trisodium nitrilotriacetate | 5 parts |
| Sodium tripolyphosphate | 1 part |
| Magnesium silicate | 1 part |
| Glauber's salt | 13 parts |

The bleaching conditions were the same as those of Example 1. The results are shown in Table 6.

TABLE 6

| Peroxide | Grade of Color change or fading |
|---|---|
| Sodium perborate ($NaBO_3 . 4H_2O$) | 5 |

TABLE 6-continued

| Peroxide | Grade of Color change or fading |
|---|---|
| Sodium sulfate/sodium chloride/ hydrogen peroxide adduct ($4Na_2SO_4 . 2H_2O_2 . NaCl$) | 5 |
| Tetrasodium ethane-1,1,2,2-tetracarboxylate/hydrogen peroxide adduct ($[CH(CO_2Na)_2]_2 . H_2O_2$) | 5 |

The embodiments of the invention in which an exclusive property or privilege is claimed are defined as follows:

1. A bleaching composition which does not cause color change or fading of fabrics, consisting essentially of 50 to 98 weight % of peroxide which releases oxygen in an aqueous solution, 1 to 49 weight % of nitrilotriacetic acid, or water-soluble salt thereof, or mixture thereof, and 1 to 49 weight % of water softener capable of removing or masking calcium ions and magnesium ions contained in hard water to convert the hard water to soft water.

2. A bleaching composition according to claim 1 containing 80 to 95 weight % of said peroxide, 3 to 10 weight % of said nitrilotriacetic acid or salt thereof and 2 to 10 weight % of said water softener.

3. A bleaching composition according to claim 1 or claim 2 wherein said peroxide is selected from the group consisting of sodium percarbonate, sodium perborate, sodium sulfate/sodium chloride/hydrogen peroxide adduct, tetrasodium ethane-1,1,2,2-tetracarboxylate/-hydrogen peroxide adduct and mixtures thereof.

4. A bleaching composition according to claim 1 or claim 2 wherein said water softener is selected from the group consisting of tripolyphosphoric acid and alkali metal salts thereof, pyrophosphoric acid and alkali metal salts thereof, and aluminosilicates.

5. A bleaching composition according to claim 1 or claim 2 wherein said peroxide is selected from the group consisting of $2Na_2CO_3.3H_2O_2$, $NaBO_3.4H_2O$, $4Na_2SO_4.NaCl.2H_2O_2$ and $[CH(CO_2Na)]_2.H_2O_2$; said water softener is selected from the group consisting of sodium tripolyphosphate, sodium pyrophosphate, sodium hexametaphosphate, sodium diglycolic acid, sodium DL-malate, sodium sulfosuccinate, sodium glutarate, sodium oxalacetate, sodium sulfoitaconate, sodium sulfotricarballyate, sodium ethanetetracarboxylate, sodium adipate, sodium tartrate, sodium n-citrate, sodium DL-isocitrate, sodium hydroxydisuccinate, sodium pyromellitate, sodium polyacrylates having a molecular weight of 3000 to 70000 and zeolites of the formula $$(Na_2O)_x.Al_2O_3.(SiO_2)_y$$

wherein x is from 0.7 to 1.5 and y is from 0.8 to 6.0; and said nitrilotriacetic acid or salt thereof is selected from the group consisting of nitrilotriacetic acid, trisodium nitrilotriacetate and disodium nitrilotriacetate.

6. A bleaching composition according to claim 2 in which said water softener consists of zeolite ion exchanger having the formula $(Na_2O)_x.Al_2O_3.(SiO_2)_y$ wherein x is a number from 0.7 to 1.5 and y is a number from 0.8 to 6.0.

7. A bleaching composition according to claim 2 in which said water softener consists of sodium polyacrylate having an average molecular weight of 3,000 to 70,000.

8. A bleaching composition according to claim 2 in which said water softener consists of a salt of polycarboxylic acid selected from the group consisting of sodium diglycollic acid, sodium DL-malate, sodium sulfosuccinate, sodium glutarate, sodium oxalacetate, sodium sulfoitaconate, sodium sulfotricarballylate, sodium ethanetetracarboxylate, sodium adipate, sodium tartrate, sodium n-citrate, sodium DL-isocitrate, sodium hydroxydisuccinate and sodium pyromellitate.

9. A bleaching composition according to claim 2 in which said water softener consists of a salt of polyphosphoric acid selected from the group consisting of sodium tripolyphosphate, sodium pyrophosphate and sodium hexametaphosphate.

* * * * *